United States Patent [19]

Brinkmeier et al.

[11] Patent Number: 4,856,396

[45] Date of Patent: Aug. 15, 1989

[54] APPARATUS FOR SELECTIVELY FORMING APERTURES OR HOLES OR VENTING PINHOLES IN A CONTINUOUSLY MOVING WEB

[75] Inventors: Friedhelm Brinkmeier, Lengerich i.W.; Ulrich Eckelt, Tecklenburg-Leeden, both of Fed. Rep. of Germany

[73] Assignee: Windmoller & Holscher, Lengerich, Fed. Rep. of Germany

[21] Appl. No.: 169,463

[22] Filed: Mar. 17, 1988

[30] Foreign Application Priority Data

Apr. 1, 1987 [DE] Fed. Rep. of Germany ..... 3710872

[51] Int. Cl.[4] ..... B26F 1/10; B26F 1/24; B31B 19/14

[52] U.S. Cl. ..... 83/300; 83/303; 83/304; 83/660; 83/670; 493/195

[58] Field of Search ..... 83/300, 301, 303–305, 83/660, 667, 668, 669, 670; 493/197, 365, 369

[56] References Cited

U.S. PATENT DOCUMENTS 4,167,131 9/1979 Habas et al. ..... 83/304

FOREIGN PATENT DOCUMENTS 2443364 3/1976 Fed. Rep. of Germany ..... 83/303

2834246 2/1980 Fed. Rep. of Germany ..... 83/303

3201610 11/1984 Fed. Rep. of Germany .

*Primary Examiner*—Frank T. Yost

*Assistant Examiner*—Hien H. Phan

*Attorney, Agent, or Firm*—Fleit, Jacobson, Cohn, Price, Holman & Stern

[57] ABSTRACT

Apparatus for selectively forming a continuously moving web (5) with apertures or holes by means of a punching mechanism consisting of a rotating die (26) and a rotating punch (14) and with venting pinholes by means of a rotating needle bar (34) and a rotating abutment (13). The die (26) or punch (14) and the needle bar (34) are secured to a common shaft (28). The punch (14) or die (26) for cooperating with the die (26) or punch (14) on the common shaft (28) is secured to a first shaft (11) on the opposite side of the web (5). The abutment (13) for cooperating with the needle bar (34) is secured to a second shaft (12) disposed on the opposite side of the web (5). The first and second shafts (11, 12) are movably mounted in pivoted mounting arms (9, 10), which can be fixed in position. A rotation of the first and second shafts (11, 12) will either move the punch (14) or die (26) into engagement with the die (26) or punch (14) or will move the needle bar (31) into engagement with the abutment (13).

6 Claims, 3 Drawing Sheets

APPARATUS FOR SELECTIVELY FORMING APERTURES OR HOLES OR VENTING PINHOLES IN A CONTINUOUSLY MOVING WEB

BACKGROUND OF THE INVENTION

1. Field of the Invention

This invention relates to apparatus for selectively forming a continuously moving web with apertures or holes by means of a punching mechanism consisting of a rotating die and a rotating punch and with venting pinholes by means of a rotating needle bar and a rotating abutment.

2. Description of the Prior Art

For instance, in machines for making continuous tubular films from flat webs of synthetic thermoplastics, which continuous tubular films are subsequently severed to form tubing sections for making sacks or bags, it is desired to form venting pinholes or thumbholes in the flat starting web which has not yet been folded to form a tubing. Such punched thumbholes are desired to ensure that a sack which has been closed at one end can be more easily opened at its open end.

In known machines for punching thumbholes or for forming venting pinholes, a shaft was provided at its center with a tool for punching thumbholes and was provided with needle bars on both sides of said tool. If sacks closed at both ends were to be made from the web when it has been folded to form a continuous tubing, only the needle bars for forming pinholes and the associated abutments were used whereas the thumbhole-punching mechanism consisting of a die and punch was disabled. When the web had been folded to form a tubing for use in making sacks which were closed only at one end and provided with an open edge at the other end, the means for forming pinholes were disabled and the thumbhole-punching mechanism was used to punch the desired thumbholes. Those known machines cannot be used to process rather narrow webs because the presence of the centrally disposed mechanism for punching thumbholes precludes the provision of the means for forming pinholes on opposite sides of said punching mechanism. In order to permit a selective forming of punched thumbholes or of venting pinholes, the corresponding punching and pinhole-forming mechanisms had to be arranged in succession and to be provided with separate drives. This involves a higher structural and mechanical expenditure and has the result that the machines have an undesirably large length.

SUMMARY OF THE INVENTION

For this reason it is an object of the invention to provide a machine which is of the kind described first hereinbefore and has a simple structure and a short length and can be used to form a web selectively with punched apertures, such as thumbholes, or with pinholes.

In an apparatus of the kind concerned that object is accomplished in accordance with the invention in that the die or punch and the needle bar are secured to a common shaft, the punch or die for cooperating with the die or punch on the common shaft is secured to a first shaft on the opposite side of the web, the abutment for cooperating with the needle bar is secured to a second shaft disposed on the opposite side of the web, and said first and second shafts are movably mounted in pivoted mounting arms, which are adapted to be fixed in position, and in such a manner that a rotation of said first and second shafts will either move the punch or die into engagement with the die or punch or will move the needle bar into engagement with the abutment. In the apparatus in accordance with the invention the die or punch and the needle bar can be mounted on one shaft and the associated cooperating tools are mounted on separate shafts, which can selectively be pivotally moved to an operative position so that the overall length is very short and at least one shaft is saved.

The die and the punch and/or the needle bar and the abutment are preferably mounted on the associated shafts so that they are axially displaceable thereon and are adapted to be fixed in position so that the locations of the punched apertures and of the pinholes in the web to be processed can freely be selected.

In accordance with a further feature of the invention the shafts which carry the die and punch, respectively, are provided with gears, which mesh with each other, the shaft which carries the die or punch and carries also the needle bar is also movably mounted in pivoted arms which are adapted to be fixed in different angular positions, the needle bar is connected to the associated shaft by a carrier, by which the radial distance from the needle bar to the shaft is adjustable, and any offset between the shaft which carries the needle bar and the shaft section provided with the drive wheel is compensated by an Oldham coupling connecting said shaft and shaft section. As a result there is only a single drive for the shafts and that drive is used to punch holes and to form pinholes. When the apparatus is used to punch holes, such as thumbholes, an adjustment to different sizes is effected by a driving crank and rocker mechanism, which causes the punching tools to move in synchronism with the web during the punching cut, i.e., over a relatively short distance.

If the spacing of the pinholes formed is to be altered in accordance with a change of size, the carrier is adjusted to change the radial distance from the needle bar to the associated shaft. The selected distance is so large that the orbital velocity of the needle bar is approximately as high as the speed of travel of the web and the eccentricity of the driving slider crank mechanism is adjusted to zero so that the needle bar will revolve at a uniform orbital velocity. A so-called Oldham coupling is provided for compensating the offset of the axes of the shaft section carrying the drive gear and the shaft which carries the needle bar.

The levers which carry the first and second shafts may be angled in an arrangement in which only the first shaft, which carries the die or punch, is rotatably mounted adjacent to the bends and the second shaft, which carries the abutment, is movably adjacent to the free ends of the levers. The abutment for cooperating with the needle bar suitably consists of a cylindrical brush.

The arms which carry the shafts are suitably provided with adjusting means for an adjustment in dependence on the desired mode of operation and/or the desired size.

DETAILED DESCRIPTION OF THE PREFERRED EMBODIMENT

An illustrative embodiment of the invention will be explained more in detail hereinafter with reference to the drawings.

Figure 2:
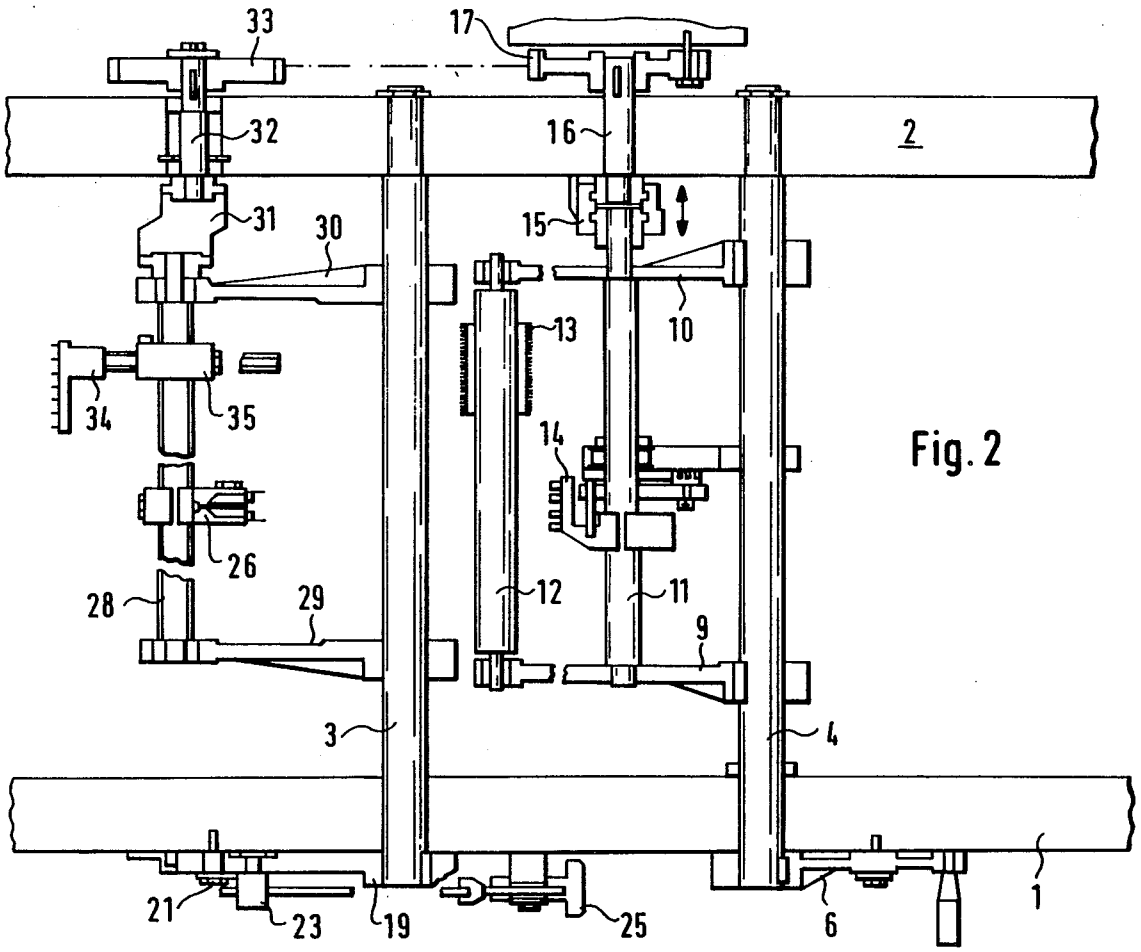
FIG. 2 is a top plan view showing the apparatus of FIG. 1 with the shafts shown in an offset arrangement for the sake of clearness.
Figure 3:
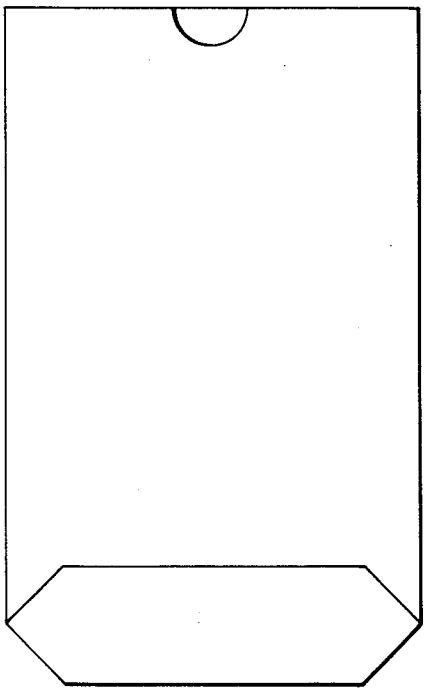
FIG. 3 shows a sack which is open at one end and provided with a thumbhole.
Figure 4:
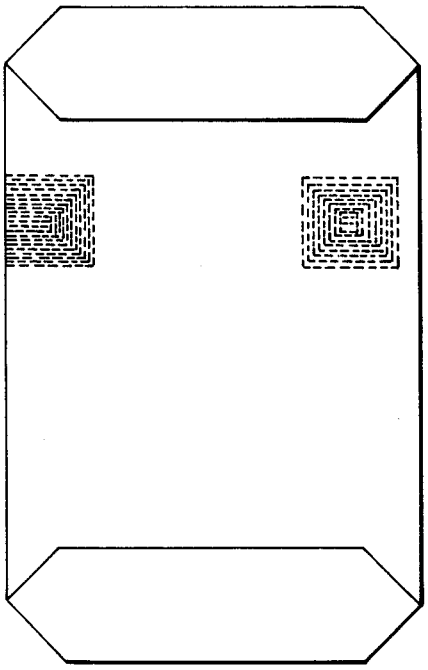
FIG. 4 shows a sack that is closed at both ends and provided with pinholes.

Two turning shafts 3 and 4 are rotatably mounted in the side frames 1, 2 of the apparatus. The turning shaft 4 is disposed under the web 5 which passes through the apparatus. One end of the turning shaft 4 protrudes out of the side frame. A shifting elver 6 is fixedly keyed to the outwardly protruding shaft portion and can be turned to two positions and fixed in said positions by means of screws 7 and 8, which are provided in the side frame 1. It is particularly apparent from FIG. 2 that angled arms or bell cranks 9 and 10 are secured to the turning shaft 4 and at their elbows carry a pivoted shaft 11 and at their leg ends carry a brush roller 12. The latter is provided in certain portions with a cylindrical brush 13.

Figure 1:
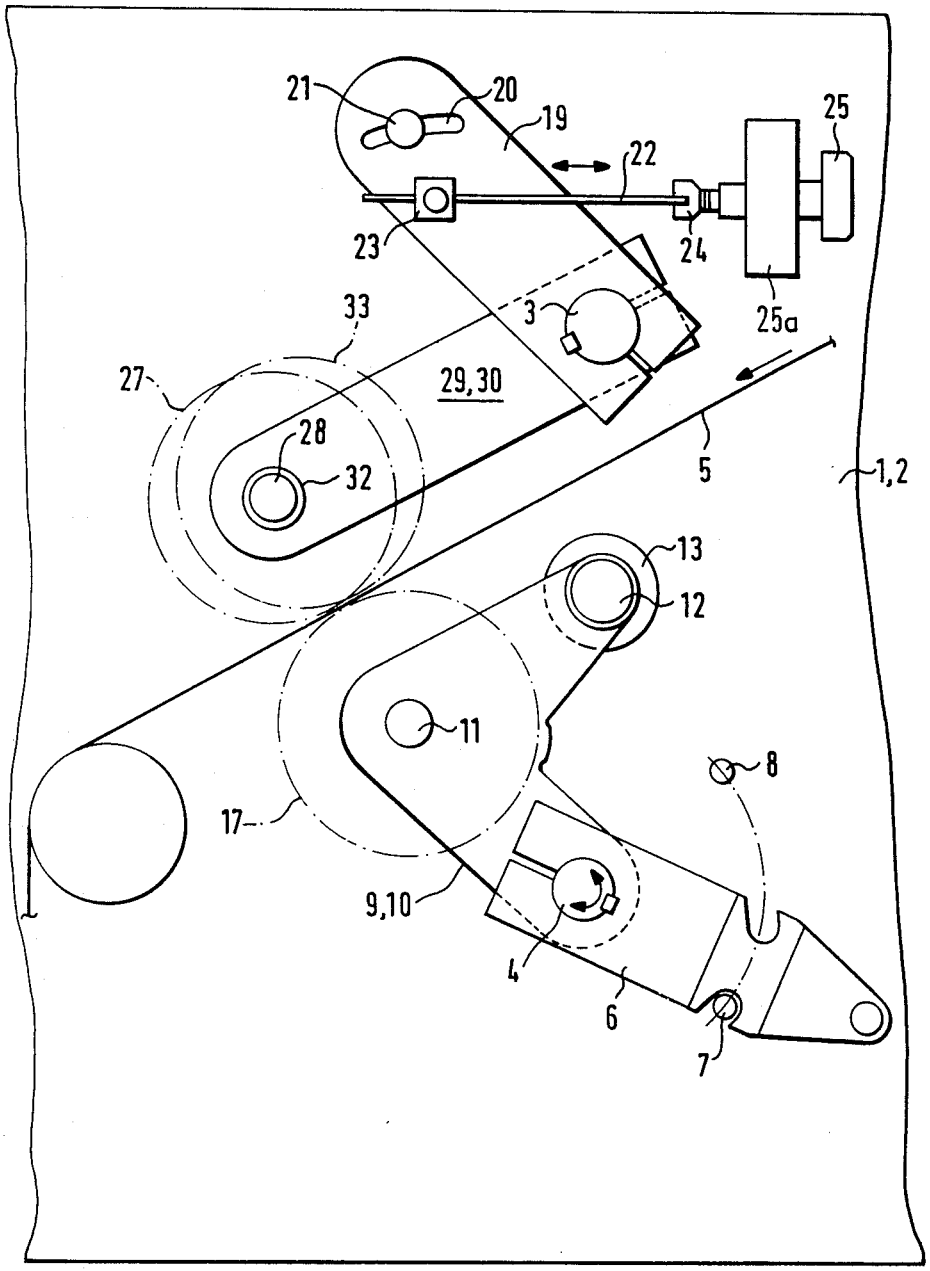
FIG. 1 is a side elevation showing the apparatus for selectively forming punched holes and pinholes.

When the pivoted shaft 11 is secured in position as shown in FIG. 1 by the cooperation of the shifting lever 6 and the screw 7, the punch 14 of a thumbhole-punching mechanism mounted on shaft 11 engages the web 5 and the cylindrical brush 13 has been turned away.

The thumbhole-punching mechanism has the design that has been described in German Patent Specification No. 32 01 610, which is incorporated herein by reference. The shaft 11 is connected by a sliding coupling 15 to a shaft section 16, which is movably mounted in the side frame 2. The shaft section 16 carries a gear 17 and is driven by a conventional slider crank mechanism, not shown.

The turning shaft 3 is movably mounted in the side frames 1 and 2 above the plane in which the web 5 travels through the apparatus. A shifting arm 19 is secured to that end of the shaft 3 which protrudes out of the side frame 1. The arm 19 has a slot 20, which is concentric to the shaft 3. A screw 21 that is adapted to be screwed into the side frame 1 extends through the slot 20 and has a head which firmly bears on the shifting arm 19 to hold the latter in position. When the screw 21 has been loosened, the position of the shifting arm 19 can be changed by means of a headless or lead screw 22, which at one end is screwed into the adjusting nut 23, which is mounted on the shifting arm 19. The other end of the screw 22 is connected by a hinge 24 to a handwheel 25. Bracket **25*a* fixed to side frame 1 supports the handwheel 25**.

When the apparatus is in the position shown in FIG. 1, the die 26 of the thumbhole-punching mechanism engages the web 5 and cooperates with the punch 14. The circular envelope of the die 26 is designated 27 in FIG. 1. The die 26 is carried by the shaft 28, which is movably mounted in two carrying arms 29 and 30, which are secured to the turning shaft 3. By means of a so-called "Oldham" coupling 31 for compensating any phase angle difference, the shaft 28 is driven by a shaft section 32 that is movably mounted in the side frame 2 and by a gear 33, which meshes with the gear 17 (FIG. 1). When the apparatus is operated to punch thumbholes the needle bar 34 mounted on the shaft 28 will not be removed unless the smallest possible working diameter of the needle bar 34 exceeds the working diameter of the die 26. The cylindrical brush 13 constitutes an abutment for the needle bar 34.

If pinholes rather than thumbholes are to be formed, the coupling 15 is displaced to separate the shaft 11 from its drive. Thereafter the screw 7 is loosened and the shifting lever 6 is shifted and is fixed in position by the screw 8. A a result, the freely rotatably mounted cylindrical brush 13 is in contact with the web 5. The needle bar 34 is then displaced in the associated holder 35 mounted on shaft 28 to such an extent that the path traveled by the needle bar during one revolution has the same length as a web section. If the outer circular envelope of the needle bar is larger than the circular envelope 27 of the die, the latter may remain on the shaft 28. Otherwise the die 26 will have to be removed. In order to ensure that the web 5 will be penetrated only by the needles of the needle bar 34, the screw 21 is loosened and the handwheel 25 is then rotated to move the shifting arm 19 to a suitable position. The crank mechanism, not shown, which is used to drive the shaft 28 is moved to a zero position by that adjustment, so that the needle bar 34 will revolve at a uniform orbital velocity, which is equal to the speed of travel of the web. As a result, the web will be punctured by the needles but will not be torn. Any phase angle difference which is due to the offset between the shaft 28 and the shaft section 32 will be compensated by the Oldham coupling 31.

It is also pointed out that during an operation of the thumbhole punching mechanism the orbital velocity of the die and of the punch is matched to the speed of travel of the web in conventional manner by an adjustment of the driving slider crank mechanism. This is appropriate because the punching mechanism acts only for short periods of time so that tears in the web need not be feared.

It will be understood that the needle bars 34 and the cylindrical brush 13 and also the punch 14 and the die 26 are axially adjustable in dependence on the desired location of the pinholes or thumbholes in the web 5.

We claim:

1. In apparatus for selectively forming a continuously moving web with apertures or holes by means of a punching mechanism including a rotating die and a cooperating rotating punch and with venting pinholes by means of a rotating needle bar and a cooperating rotating abutment, the improvement comprising one of the die or punch and the needle bar secured to a common shaft on one side of the web, said other of the punch or die for cooperating with the said one of the die or punch on the common shaft secured to a first shaft on the opposite side of the web, the abutment for cooperating with the needle bar secured to a second shaft disposed on the opposite side of the web, and said first and second shafts being movably mounted in pivoted mounting arms, which are adapted to be fixed in position, and in such a manner that said first and second shafts can be positioned to place selectively the other of the punch or die into engagement with the said one of the die or punch or the needle bar into engagement with the abutment.

2. In apparatus according to claim 1, wherein the needle bar and the abutment are axially displaceably mounted on their respective shafts and means are provided to fix the needle bar and abutment in position.

3. In apparatus according to claim 1, wherein gear means are provided to drive the shafts which carry the die and punch, respectively, the common shaft which carries the said one of the die or punch and also carries the needle bar being movably mounted on pivoted arms fixedly positioned in different angular positions, the needle bar being connected to the common shaft by a carrier, by which the radial distance from the needle bar to the shaft common is adjustable, and any offset between the shaft common which carries the needle bar and its drive being compensated by an phase angle compensating coupling.

4. In apparatus according to claim 1, wherein the mounting arms which carry the first and second shafts are bell cranks with the first shaft rotatably mounted adjacent to the bell crank elbows and the second shaft movably mounted adjacent to free ends of the cranks.

5. In apparatus according to claim 1, wherein the abutment comprises a cylindrical brush.

6. In apparatus according to claim 1, wherein the mounting arms are mounted on turning shafts provided with adjusting means.

* * * * *